US011771938B2

(12) United States Patent
Havelka-Rivard et al.

(10) Patent No.: US 11,771,938 B2
(45) Date of Patent: Oct. 3, 2023

(54) FIREFIGHTING FOAM COMPOSITIONS CONTAINING DEEP EUTECTIC SOLVENTS

(71) Applicant: Tyco Fire Products LP, Lansdale, PA (US)

(72) Inventors: Pamela Havelka-Rivard, Wallace, MI (US); Stephen A. Barker, Menominee, MI (US); Mark Adam-Christopher Siem, Menominee, MI (US)

(73) Assignee: Tyco Fire Products LP, Cranston, RI (US)

( * ) Notice: Subject to any disclaimer, the term of this patent is extended or adjusted under 35 U.S.C. 154(b) by 134 days.

(21) Appl. No.: 16/319,885

(22) PCT Filed: Jul. 26, 2017

(86) PCT No.: PCT/US2017/043969

§ 371 (c)(1),
(2) Date: Jan. 23, 2019

(87) PCT Pub. No.: WO2018/022763

PCT Pub. Date: Feb. 1, 2018

(65) Prior Publication Data

US 2019/0262647 A1 Aug. 29, 2019

Related U.S. Application Data

(60) Provisional application No. 62/368,760, filed on Jul. 29, 2016.

(51) Int. Cl.
*A62D 1/00* (2006.01)
*A62D 1/02* (2006.01)

(52) U.S. Cl.
CPC ..... *A62D 1/0071* (2013.01)

(58) Field of Classification Search
None
See application file for complete search history.

(56) References Cited

U.S. PATENT DOCUMENTS 1,431,789 A * 10/1922 Hamilton ..... A62D 1/0071 169/44
1,874,209 A 8/1932 Schnabel
3,047,619 A 7/1962 Brace
3,257,407 A 6/1966 Brace
3,258,423 A 6/1966 Tuve et al.
3,422,011 A 1/1969 Jackovitz et al.
3,457,172 A 7/1969 Stewart et al.
3,562,156 A 2/1971 Francen
3,579,446 A 5/1971 Kroke et al.
3,621,059 A 11/1971 Bartlett
3,655,555 A 4/1972 Rossmy et al.
3,661,776 A 5/1972 Fletcher et al.
3,677,347 A 7/1972 Rosen et al.
3,759,981 A 9/1973 Hager et al.
3,772,199 A 11/1973 Tamai et al.
3,789,265 A 1/1974 Holz et al.
3,828,085 A 8/1974 Price et al.
3,839,425 A 10/1974 Bartlett et al.
3,849,315 A 11/1974 Chiesa, Jr.
3,941,708 A 3/1976 Gentit et al.
3,957,657 A 5/1976 Chiesa, Jr.
3,957,658 A 5/1976 Chiesa et al.
3,963,776 A 6/1976 Middleton
4,038,198 A 7/1977 Wagner et al.
4,042,522 A 8/1977 Falk
4,049,556 A 9/1977 Tujimoto et al.
4,060,132 A 11/1977 Chiesa, Jr.
4,060,489 A 11/1977 Chiesa, Jr.
4,069,158 A 1/1978 Bertocchio et al.
4,090,976 A 5/1978 Dehollander et al.
4,099,574 A 7/1978 Cooper et al.
4,149,599 A 4/1979 Chiesa, Jr.
4,203,850 A 5/1980 Wirtz et al.
4,209,407 A 6/1980 Schuierer et al.
4,306,979 A 12/1981 Tsuji
4,387,032 A 6/1983 Chiesa, Jr.
4,420,434 A 12/1983 Falk
4,424,133 A 1/1984 Mulligan
4,464,267 A 8/1984 Chiesa et al.
4,588,510 A 5/1986 Salyer et al.
5,207,932 A 5/1993 Norman et al.
(Continued)

FOREIGN PATENT DOCUMENTS

WO WO-03/049813 A1 6/2003
WO WO-2009/042847 A1 4/2009
(Continued)

OTHER PUBLICATIONS

Liu, Y.-T. et al., Synthesis and Characterization of Novel Ternary Deep Eutectic Solvents. Chin. Chem. Lett. 2014, 25, 104-106.
Dai, Y.; Witkamp, G.-J.; Verpoorte, R.; Choi, Y. H. Tailoring Properties of Natural Deep Eutectic Solvents with Water to Facilitate Their Applications. Food Chemistry. 2015, 187, 14-19.
Garcia, G.; Aparicio, S.; Ullah, R.; Atilhan, M. Deep Eutectic Solvents: Physicochemical Properties and Gas Separation Applications. Energy & Fuels. 2015, 29, 2616-2644.
Wagle, D. V.; Zhao, H.; Baker, G. A. Deep Eutectic Solvents: Sustainable Media for Nanoscale and Functional Materials. Accounts of Chemical Research Acc. Chem. Res. 2014, 47, 2299-2308.
Zhang, Q. et al., Deep Eutectic Solvents: Syntheses, Properties and Applications. Chem. Soc. Rev. 2012, 41, 7108.
(Continued)

*Primary Examiner* — Tanisha Diggs
(74) *Attorney, Agent, or Firm* — Foley & Lardner LLP

(57) ABSTRACT

The disclosed invention relates to novel biocompatible firefighting foam compositions that include a deep eutectic solvent. Disclosed are methods of making and using firefighting foams containing deep eutectic solvents, which may also be used in existing fire foam compositions as drop in solvent additives. The deep eutectic solvents may also be used in or as a principle component of surrogate firefighting foam compositions.

30 Claims, No Drawings

(56) References Cited

U.S. PATENT DOCUMENTS

| | | | |
|---|---|---|---|
| 5,218,021 | A | 6/1993 | Clark et al. |
| 5,616,273 | A | 4/1997 | Clark et al. |
| 5,750,043 | A | 5/1998 | Clark |
| 5,820,776 | A | 10/1998 | Hansen et al. |
| 5,882,541 | A | 3/1999 | Achtmann |
| 5,997,758 | A | 12/1999 | Barbarin et al. |
| 6,262,128 | B1 | 7/2001 | Stern et al. |
| 7,381,696 | B2 | 6/2008 | Hubert et al. |
| 7,569,155 | B2 | 8/2009 | Schaefer |
| 7,868,167 | B2 | 1/2011 | Harding et al. |
| 8,247,198 | B2 | 8/2012 | Gorke et al. |
| 8,298,436 | B2 | 10/2012 | Michael |
| 8,431,036 | B2 | 4/2013 | Mulligan et al. |
| 8,524,104 | B1 | 9/2013 | Michael |
| 8,946,486 | B2 | 2/2015 | Martin |
| 9,259,602 | B2 | 2/2016 | Robinet et al. |
| 9,669,246 | B2 | 6/2017 | Bowen et al. |
| 9,687,686 | B2 | 6/2017 | Blunk et al. |
| 9,956,447 | B2 | 5/2018 | Martin et al. |
| 9,956,448 | B2 | 5/2018 | Martin |
| 10,004,191 | B2 | 6/2018 | Vreugdenhil |
| 10,173,089 | B2 | 1/2019 | Xie |
| 2001/0001478 | A1 | 5/2001 | Dams et al. |
| 2005/0118106 | A1 | 6/2005 | Schaefer |
| 2008/0196908 | A1 | 8/2008 | Schaefer |
| 2010/0200799 | A1 | 8/2010 | Mouli |
| 2011/0039467 | A1 | 2/2011 | Xu |
| 2014/0202716 | A1 | 7/2014 | Klaffmo et al. |
| 2014/0275305 | A1 | 9/2014 | Svenson et al. |
| 2015/0118106 | A1 | 4/2015 | Hyde et al. |
| 2016/0001115 | A1 | 1/2016 | Blunk et al. |
| 2016/0023032 | A1 | 1/2016 | Bowen |
| 2016/0030793 | A1 | 2/2016 | Xie |
| 2016/0038778 | A1 | 2/2016 | Siem |
| 2016/0038779 | A1 | 2/2016 | Bowen et al. |
| 2016/0166867 | A1 | 6/2016 | Hansen et al. |
| 2017/0182341 | A1 | 6/2017 | Libal |

FOREIGN PATENT DOCUMENTS

| | | | | |
|---|---|---|---|---|
| WO | WO-2012/021146 | A1 | 2/2012 | |
| WO | WO-2012/045080 | A1 | 4/2012 | |
| WO | WO-2012/145522 | | 10/2012 | |
| WO | WO-2014/153140 | A1 | 9/2014 | |
| WO | WO-2014153154 | A1 * | 9/2014 | ..... A62D 1/0035 |
| WO | WO-2015/128550 | A1 | 9/2015 | |
| WO | WO-2017/161156 | A1 | 9/2017 | |
| WO | WO-2017/161162 | A1 | 9/2017 | |

OTHER PUBLICATIONS

Dai, Y et al., Natural Deep Eutectic Solvents as New Potential Media for Green Technology, Analytica Chimica Acta, 2013, 766, 21 pages.

Dai, Y. et al., Ionic Liquids and Deep Eutectic Solvents in Natural Products Research: Mixtures of Solids as Extraction Solvents, J. Nat. Prod. Journal of Natural Products, 2013, 76, 2162-2173.

International Search Report and Written Opinion for International Application No. PCT/US2017/043969, dated Jan. 4, 2018, 16 pages.

English abstract for European publication No. EP0659449A1, publication date Jun. 28, 1995.

English abstract for German publication No. DE2937333A1, publication date Apr. 2, 1981.

English abstract for Japanese publication No. JP02286325A, publication date Nov. 26, 1990.

English abstract for Japanese publication No. JP04093686A, publication date Mar. 26, 1992.

English abstract for Japanese publication No. JP2001072930A, publication date Mar. 21, 2001.

English abstract for Japanese publication No. JP60215091A, publication date Oct. 28, 1985.

* cited by examiner

FIREFIGHTING FOAM COMPOSITIONS CONTAINING DEEP EUTECTIC SOLVENTS

CROSS REFERENCE TO RELATED PATENT APPLICATIONS

This application is a national stage entry of International Patent Application No. PCT/US2017/043969, filed Jul. 26, 2017, which claims priority to U.S. Provisional Patent Application No. 62/368,760, filed Jul. 29, 2016, each of which are incorporated herein by reference in their entirety.

TECHNICAL FIELD

The disclosed invention relates to novel biocompatible firefighting foam compositions that include a deep eutectic solvent. Disclosed are methods of making and using firefighting foams containing deep eutectic solvents, which may also be used in existing fire foam compositions as drop in solvent additives. The deep eutectic solvents may also be used in or as a principle component of surrogate firefighting foam compositions.

BACKGROUND INFORMATION

Conventional firefighting foam materials are prepared by aerating or trapping air within a concentrated foaming composition. These foams are typically prepared from concentrates by diluting with water and aerating the mixture to form foam. These foams are then dispensed onto a fire, which forms a thick foam blanket that suffocates and extinguishes a fire by reducing oxygen availability.

An important class of firefighting foams includes aqueous film-forming foams (AFFFs). An important characteristic of these firefighting foams is stability over an extended period of time and burn back resistance. Conventional foams include fluorinated and perfluorinated surfactants such as perfluorooctanesulphonate (PFOS), perfluorooctanoic acid (PFOA) and fluorotelomer-based surfactants. These surfactants exhibit low surface tension, high foaming and spreading abilities, and demonstrate good burn back resistance due to the presence of fluoro groups. However, the negative environmental impact of foams including perfluorochemicals has been recognized resulting in restricted use or a complete ban of foams containing perfluorochemicals in certain countries.

The environmental impact of foams including perfluorochemicals results from the long half-life of these chemicals in the environment. Chemicals such as PFOS are resistant to hydrolysis, photolysis, microbial degradation, and vertebrate metabolism. For example, PFOS and PFOA have been shown to accumulate in water and reduce oxygen supply to aquatic life. These chemicals may also accumulate in the liver of mammals and demonstrate acute toxicity.

Some progress has been made in the development of non-perfluorinated firefighting foams. However, there remains a need for alternative components for improved properties.

Other recent trends look to increase the polysaccharide loadings in foams to offset the decreased performance when the traditional telomer perfluorinated surfactants are removed. With the higher loadings of polysaccharide materials many commercially available firefighting foams are un-stable and separate diminishing, eliminated, or increase the hazards instead of acting as a useful fire protection product. Each methodology has challenges to overcome when trying to protect a fire hazard.

Despite the environmental consequences of many petroleum based solvents, polymers, and surfactants, it remains necessary to produce firefighting foams that meet performance based criteria. Therefore, there is an unmet need for a "green solvent", which functions to stabilize the foam and solubilize key active ingredients in firefighting foam compositions. Yet, it has been nearly impossible to find solvents that are both useful as components of firefighting foams and that fall into the category of non-toxic, non-flammable, and non-corrosive materials.

In addition, firefighting foam systems must be tested often to ensure that the systems are operating and are effective and efficient. Typically firefighting equipment must be tested quarterly or annually in discharge tests. These discharge tests generally verify that the firefighting foam systems are properly functioning, which helps ensure that the firefighting equipment is operational when actually needed. During this routine testing a significant amount of waste firefighting foam materials is produced, which can result in environmental damage for the forgoing reasons. These tests can require that the toxic foam waste discharged during a test must be contained and transported to a hazardous waste containment facility for treatment, which is a costly process.

Thus, there is still a critical need for improvement over the current fluorine free foams by decreasing the acute toxicity of foam compositions by developing new technology to replace harsh solvents, polymers, and surfactants that result in stable and useful firefighting foams. Also, there is a need for foam ingredients that reduce the amount of fluorinated product discharge during annual firefighting equipment testing.

Thus, there is a recognized need for both new fluorine-free firefighting foams and surrogate foams for firefighting testing, which minimize impact to the environment. In particular, there is a need for new solvent systems, which allow for the use of all natural ingredients for minimizing potential environmental impact. These foams ideally should demonstrate excellent foaming, stability and spreading ability in addition to burn back resistance.

BRIEF SUMMARY

One embodiment is a firefighting foam composition including a deep eutectic solvent and one or more additional firefighting foam components dissolved or dispersed in the deep eutectic solvent.

In some embodiments, the firefighting foam composition includes one or more additional firefighting foam components including one or more surfactants, one or more additional solvents, one or more electrolytes, one or more foam stabilizers, one or more film formers, one or more corrosion inhibitors, or one or more antimicrobials, or a combination thereof.

In some embodiments, the deep eutectic solvent includes a mixture of a first compound and a second compound or a mixture of a first compound, a second compound, and a third compound, wherein the melting point of the mixture of the first and second compounds is lower than the melting point of the first compound and the second compound alone; or wherein the melting point of the mixture of the first, second, and third compounds is lower than the melting point of the first, second, and third compounds alone.

In some embodiments, the deep eutectic solvent includes at least one hydrogen bond donor and at least one hydrogen bond acceptor. In some embodiments, the deep eutectic solvent includes a lewis acid. In some embodiments, the deep eutectic solvent includes a lewis base. In some embodiments, the deep eutectic solvent includes a cation, an anion, a zwitterion, or a neutral compound, or a combination thereof.

In some embodiments, the deep eutectic solvent includes an organic acid, an amide, a carbamide, an azole, an aromatic acid, an aliphatic acid, an alcohol, a diol, a triol, a sugar, a sugar alcohol, an amino acid, a betaine, an alkyl betaine, a quaternary ammonium salt, or a phosphonium salt, or a combination thereof.

In one embodiment, the sugar or sugar alcohol present in the deep eutectic solvent includes sucrose, glucose, fructose, lactose, maltose, cellobiose, arabinose, ribose, ribulose, galactose, rhamnose, raffinose, xylose, mannose, trehalose, mannitol, sorbitol, inositol, xylitol, ribitol, galactitol, erythritol, or adonitol, or a combination thereof.

In another embodiment, the organic acid present in the deep eutectic solvent includes malic acid, maleic acid, malonic acid, citric acid, lactic acid, pyruvic acid, fumaric acid, succinic acid, itaconic acid, levulinic acid, glycolic acid, glutaric acid, phenylpropionic acid, phenylacetic acid, acetic acid, aconitic acid, tartaric acid, ascorbic acid, oxalic acid, glucuronic acid, neuraminic acid, phytic acid, or sialic acid, or a combination thereof.

In another embodiment, the amino acid present in the deep eutectic solvent includes γ-amino butyric acid, alanine, β-alanine, glutamic acid, aspartic acid, asparagine, lysine, arginine, proline, or threonine, or a combination thereof.

In another embodiment, the betaine present in the deep eutectic solvent includes trimethylglycine.

In another embodiment, the quaternary ammonium salt and phosphonium salt present in the deep eutectic solvent includes choline, N-ethyl-2-hydroxy-N,N-dimethylethanaminium, ethyl ammonium, 2-chloro-N,N,N-trimethylethanaminium, 2-fluoro-N,N,N-trimethylethanaminium, tetrabutylammonium, tetrapropylammonium, N,N-diethylethanolammonium, N,N,N-trimethyl(phenyl)methanaminium, N-benzyl-2-hydroxy-N-(2-hydroxyethyl)-N-methylethanaminium, 2-(acetyloxy)-N,N,N-trimethylethanaminium, 1-butyl-3-methylimidazolium, benzyltriphenylphosphonium, or methyltriphenylphosphonium or a combination thereof.

In another embodiment, the salt present in the deep eutectic solvent includes a halide salt.

In another embodiment, the amide and carbamide present in the deep eutectic solvent includes urea, methylurea, acetamide, or methylacetamide, or a combination thereof.

In some embodiments, the deep eutectic solvent is a natural deep eutectic solvent.

In some embodiments, the deep eutectic solvent includes a first compound selected from a quaternary ammonium salt and a second compound selected from an organic acid, an amino acid, a sugar, and a sugar alcohol.

In some embodiments, the deep eutectic solvent includes a first compound selected from an organic acid and a second compound selected from a sugar and a sugar alcohol.

In some embodiments, the deep eutectic solvent includes a first compound selected from a sugar and a sugar alcohol and a second compound selected from a different sugar and a different sugar alcohol.

In some embodiments, the deep eutectic solvent includes a first compound selected from an amino acid and a second compound selected from a sugar and a sugar alcohol.

In some embodiments, the deep eutectic solvent includes a first compound selected from a betaine and a second compound selected from an organic acid and an amino acid.

In some embodiments, the deep eutectic solvent includes a first compound selected from a quaternary ammonium salt and a second compound selected from an organic acid and a third compound selected from an amino acid.

In some embodiments, the deep eutectic solvent includes a first compound selected from a sugar and a sugar alcohol, a second compound selected from a sugar and a sugar alcohol, and a third compound selected from a sugar and a sugar alcohol, wherein the first, second, and third compounds cannot be the same.

In one embodiment, the deep eutectic solvent includes a first, second, and third compound selected the group consisting of from sucrose, glucose, and fructose.

In some embodiments, the deep eutectic solvent includes a first compound selected from an organic acid and an amino acid, a second compound selected from a sugar and a sugar alcohol, and a third compound selected from a sugar and a sugar alcohol, wherein the second and third compounds cannot be the same.

In some embodiments, a ratio of the first compound to the second compound present in the deep eutectic solvent ranges from about 1:12 to about 12:1. In some embodiments, a ratio of the first compound to the second compound to the third compound present in the deep eutectic solvent ranges from about 1:1:1 to about 12:1:1.

In some embodiments, the deep eutectic solvent has a viscosity of about 10 cps to about 10,000 cps. In some embodiments, the deep eutectic solvent has a melting point of about −40° C. to about 5° C. In some embodiments, the deep eutectic solvent has a freezing point of about −40° C. to about 5° C.

In some embodiments, the deep eutectic solvent is about 10% to about 85% by weight of the fire foam composition.

In some embodiments, the deep eutectic solvent promotes the solubility of biopolymer saccharides. In some embodiments the deep eutectic solvent promotes the solubility of biopolymer saccharides including, chitin, chitosan, dextran, maltodextrin, diutan gum, xanthan gum, rhamsan gum, agar, or alginates or a combination thereof.

In some embodiments, the firefighting foam composition includes one or more surfactants including a non-ionic surfactant, a zwitterionic surfactant, or an anionic surfactant, or a combination thereof.

In some embodiments, the one or more surfactants present in the firefighting foam composition includes a non-ionic surfactant selected from polyoxyethylene derivatives of alkylphenols, linear or branched alcohols, fatty acids, alkylamines, alkylamides, acetylenic glycols, alkyl glycosides, alkyl polyglycosides, and saponins.

In some embodiments the one or more surfactants present in the firefighting foam composition includes a zwitterionic surfactant selected from amine oxides, aminopropionates, sultaines, sulfobetaines, alkyl sulfobetaines, alkyl betaines, alkylamidobetaines, dihydroxyethyl glycinates, imadazoline acetates, imidazoline propionates, and imidazoline sulfonates. In some embodiments the one or more surfactants present in the firefighting foam composition includes an anionic surfactant selected from alkyl carboxylates and alkyl sulfates.

In some embodiments, the firefighting foam composition includes one or more additional solvents selected from hexylene glycol, butyl carbitol, butyl cellulose, polyethylene glycol, methyl diproxitol, propylene glycol, propylene glycol n-propyl ether, and tripropylene glycol methyl ether.

In some embodiments, the firefighting foam composition includes one or more additional stabilizers selected from ethylene glycol monoalkyl ethers, polyethylene glycol, diethylene glycol monoalkyl ethers, propylene glycol, dipropylene glycol monoalkyl ethers, triethylene glycol monoalkyl ethers, 1-butoxyethoxy-2-propanol, glycerine, hexylene glycol, and trimethylglycine.

In some embodiments, the firefighting foam is selected from a low-expansion foam, a medium expansion foam, and a high-expansion foam. In some embodiments, the firefighting foam composition includes less than about 5% by weight of a fluorine containing compound. In some embodiments, the firefighting foam composition is substantially free of fluorine containing compounds.

In some embodiments, the firefighting foam composition is a surrogate firefighting foam composition for use in annual firefighting testing.

Another embodiment is a method of making the firefighting foam composition disclosed herein, including:

a) preparing or providing a deep eutectic solvent mixture of two or more ingredients;
b) adding a film forming polymer and agitating the mixture; and
c) adding sufficient water to decrease the viscosity of the preparation.

In another embodiment, the method of making the firefighting foam composition further includes:

i) adding a first surfactant to the mixture; and
ii) adding a second surfactant to the mixture, wherein the first and second surfactants are added prior to step c).

In another embodiment, the method of making the firefighting foam composition further includes adding one or more additional components including one or more surfactants, one or more additional solvents, one or more electrolytes, one or more foam stabilizers, one or more additional film formers, one or more corrosion inhibitors, or one or more antimicrobials prior to step c).

Another embodiment is a firefighting foam composition made by the methods disclosed herein.

Another embodiment is a method of extinguishing a fire including administering the firefighting foam composition disclosed herein to a fire. In another embodiment, the fire extinguished following the method disclosed herein is a class A fire, a class B, a class C fire, or a class K fire.

DETAILED DESCRIPTION

The following paragraphs define in more detail the embodiments of the invention described herein. The following embodiments are not meant to limit the invention or narrow the scope thereof, as it will be readily apparent to one of ordinary skill in the art that suitable modifications and adaptations may be made without departing from the scope of the invention, embodiments, or specific aspects described herein. All patents and publications cited herein are incorporated by reference herein in their entirety.

For purposes of interpreting this specification, the following terms and definitions will apply and whenever appropriate, terms used in the singular will also include the plural and vice versa. In the event that any definition set forth below conflicts with any document incorporated herein by reference, the definition set forth below shall control.

The term "alkyl" as used herein alone or as part of another group, refers to a straight or branched chain hydrocarbon containing from 1 to 10, 20, or 30 or more carbon atoms. As used herein, the denotation $C_n$-$C_{n+m}$ refers to the number of carbons as a straight or branched alkyl chain, wherein n and m are integers greater than 1. Representative examples of alkyl include, but are not limited to, methyl, ethyl, n-propyl, iso-propyl, n-butyl, sec-butyl, iso-butyl, tert-butyl, n-pentyl, isopentyl, neopentyl, n-hexyl, 3-methylhexyl, 2,2-dimethylpentyl, 2,3-dimethylpentyl, n-heptyl, n-octyl, n-nonyl, n-decyl, and the like.

The term "cyclic" or "cycloalkyl" as used herein alone or as part of another group, refers to a saturated or partially unsaturated cyclic hydrocarbon group containing from 3, 4 or 5 to 6, 7 or 8 carbons (which carbons may be replaced in a heterocyclic group as discussed below). Representative examples of cycloalkyl include cyclopropyl, cyclobutyl, cyclopentyl, cyclohexyl, cycloheptyl, and cyclooctyl. The term "cycloalkyl" is generic and intended to include heterocyclic groups as discussed below unless specified otherwise.

The term "aryl" or "aromatic" as used herein alone or as part of another group, refers to a monocyclic carbocyclic ring system or a bicyclic carbocyclic fused ring system having one or more aromatic rings. Representative examples of aryl include benzyl, azulenyl, indanyl, indenyl, naphthyl, phenyl, tetrahydronaphthyl, and the like. The term "aryl" or "aromatic" is intended to include both substituted and unsubstituted aryl or aromatic unless otherwise indicated.

The term "heterocyclic" as used herein alone or as part of another group, refers to an aliphatic (e.g., fully or partially saturated heterocyclic) or aromatic (e.g., heteroaryl) monocyclic- or bicyclic-ring system. Monocyclic ring systems are exemplified by any 3, 4, 5 or 6 membered ring containing 1, 2, 3, or 4 heteroatoms (i.e., other than a carbon atom) independently selected from oxygen, nitrogen and sulfur. The 5 membered ring has from 0-2 double bonds and the 6 membered ring has from 0-3 double bonds. Therefore the term "heterocyclic" as used herein also encompasses heteroaromatic and heteroaryl groups.

As used herein, the term "foam" or "firefighting foam" refers to a stable mass of low-density air-filled bubbles. The density of these bubbles is lower than the solvent being coated with the foam, and thus, remains on top of the solvent to which the foam is being dispensed. As further described herein, the foams form a homogenous blanket for extinguishing a fire.

As used herein, the term "concentrate" or "foam concentrate" refers to a liquid concentrated solution, which when mixed with water at a specified ratio as described further herein forms a foam solution.

As used herein, the term "control" of a firefighting foam is the time it takes for the expanded foam mass to spread over 90% of the fuel or solvent to which the foam is being dispensed.

As used herein, the term "torch test" refers to the procedure of passing a small flame over the surface of firefighting foam. The torch is used to verify the foam blanket has sealed the fuel surface not allowing for vapors to permeate through the foam and reignite above the fuel surface.

As used herein, the term "drainage" refers to liquid which drains from the foam solution. The drainage rate is recorded as the period of time necessary for the liquid to drain from the foam, for example 25% or 50% of the fluid.

As used herein, the term "expansion rate" or "expansion rate ratio" refers to the volume of expanded foam divided by the volume of foam concentrate used to create the expanded foam. For example, an expansion rate ratio of 5 to 1 indicates that one litre of foam solution after aeration would fill an empty five-litre container with the expanded foam mass.

As used herein, the term "eutectic solvent" or "deep eutectic solvent" refers to a mixture of two or more compounds, which demonstrates a melting point that is lower than either of the compounds alone. For example a eutectic mixture of two compounds A and B would have a melting point that is lower than compound A or B alone and is known as a binary eutectic mixture. Similarly a eutectic mixture of three compounds A, B, and C would have a melting point that is lower than compound A, B, or C alone and is known as a ternary eutectic mixture, see, for example, Liu, Y.-T. et al., Synthesis And Characterization of Novel Ternary Deep Eutectic Solvents. *Chin. Chem. Lett.* 2014, 25, 104-106. The point in a phase diagram, where the chemical composition and temperature correspond to the lowest melting point of a mixture of components is the eutectic point of the mixture. Generally, eutectic solvents having a freezing point depression greater than 150° C. are referred to as "deep eutectic solvents."

As used herein, the term "class A fire" refers to ordinary solid combustibles. Examples of such combustible materials include paper and wood.

As used herein, the term "class B fire" refers to flammable liquids and gases. Examples of such combustible materials include combustible liquids, petrol, grease, and oil.

As used herein, the term "class C fire" refers to energized electrical equipment fires.

As used herein, the term "class D fire" refers to combustible metal fires.

As used herein, the term "class K fire" refers to kitchen fires. Examples of combustible kitchen fire fuels include cooking oils, grease, and animal fat.

Deep Eutectic Solvents

As described herein, it was found that eutectic solvent systems (ES), such as deep eutectic solvents (DES) were shown to be well suited for use in firefighting foam compositions. It was discovered that these eutectic solvents demonstrate excellent solubilizing and firefighting foam characteristics. In particular, eutectic solvents sourced from natural ingredients such as natural deep eutectic solvents are described.

Deep eutectic solvents typically contain at least one hydrogen bond donor and at least one hydrogen bond acceptor. Traditionally, they have been obtained by the mixing of a quaternary ammonium halide salt, (e.g., the hydrogen bond acceptor) with an organic acid, alcohol, or sugar (e.g., hydrogen bond donor). They differ from ionic liquids in that they are not composed entirely of ions.

The first eutectic solvents were based on a salt of choline chloride and urea in a 1:2 molar ratio. Deep eutectic solvents have numerous advantages including that they can easily be prepared with 100% atom economy or no waste in making the solvent system without any need for purification steps. In addition, deep eutectic solvents have a wide liquid range, are compatible with water, have a low vapor pressure, non-flammability, and non-toxic. The large diversity of potential combinations for forming a deep eutectic solvent provide for a powerful tool in controlling the physical properties of the deep eutectic solvents.

Natural deep eutectic solvents are composed primarily of naturally occurring primary metabolites including sugars, sugar alcohols, organic acids, amino acids, and amines and are further characterized by extensive intermolecular interactions. They also include water in certain molar ratios. Environmentally, natural deep eutectic solvents offer many advantageous including low cost, biodegradability, sustainability, and simple preparation. These types of natural eutectic solvents pose less environmental hazards than synthetic ionic liquids, which often suffer from a higher toxicity due to the presence of typically high halide content.

The deep eutectic solvents described herein are particularly useful for dissolving or partially dissolving biopolymer saccharides, such as starch, chitin, chitosan, dextran, maltodextran, dextrin, maltodextrin, gums, agar, alginates, and other macromolecules. In addition, the eutectic solvents in and of themselves have unique firefighting properties alone and with other traditional ingredients used in firefighting foams.

It was found that the use of these deep eutectic solvents has helped overcome the shortcoming of low MW PEGs, glycols, and other solvents as wetting agents to incorporate the above mentioned biopolymer saccharides into a foam composition. They are unique due to their natural product origins and mimicking the solubilization that occurs in living organisms. Thus, the ionic solvents described herein, in particular naturally occurring deep eutectic solvents are ideal candidates for firefighting foam compositions due to their pharmaceutically acceptable toxicity profile. Testing on full scale fires has also proven that the deep eutectic solvents and natural deep eutectic solvents to be firefighting agents.

Further, these deep eutectic solvents function to dissolve many natural saccharides, which allow for additional all-natural ingredients to be sourced from the food industry. The use of these ingredients will provide for a previously unrealized technological breakthrough in developing environmentally responsible fire foams.

Deep eutectic solvents and natural deep eutectic solvents have been used previously for organic synthesis, catalysis, in biodiesel transformation, electrochemistry, nanotechnology, enzymatic processing, and in gas separation ($CO_2$ capture) technologies. Additionally, natural deep eutectic solvents have garnered much attention in the health-related areas including pharmaceuticals, foods, cosmetics, enzyme processing, the extraction of natural chemicals, processing biomass, and in the stabilization of natural pigments.

Despite the numerous environmental benefits of deep eutectic solvents and natural deep eutectic solvents and the wide spread desire to develop more environmentally friendly firefighting foams, they have never been contemplated or successfully developed for use in firefighting foams. For example, PCT International Patent Pub. No. WO2012/021146 is focused on the development of a more environmentally friendly solvent system and describes the use of purely ionic liquids with fluorine containing counter anions for use as flame retardants. These ionic liquids were not a eutectic or deep eutectic solvent. As discussed above, the broad use of these types of ionic liquids, in particular ones containing fluorine, have been found to be damaging to the environment.

Thus, described are fire foam compositions including a deep eutectic solvent system. In some embodiments, these solvents may be sourced from all natural ingredients and are a natural deep eutectic solvent. Useful deep eutectic solvents may include a plurality of compounds that form a eutectic mixture. Generally deep eutectic solvents are formed by mixing two or more solids that are then capable of generating a liquid phase via hydrogen bonding and self-association. Deep eutectic solvents and natural deep eutectic solvents are generally described in, for example, U.S. Pat. No. 8,247,198; PCT International Patent Pub Nos. WO2012/145522 and WO2015/128550, and also in Garcia, G.; Aparicio, S.; Ullah, R.; Atilhan, M. Deep Eutectic Solvents: Physicochemical Properties and Gas Separation Applications. *Energy & Fuels.* 2015, 29, 2616-2644; Wagle, D. V.; Zhao, H.; Baker, G. A. Deep Eutectic Solvents: Sustainable Media for Nanoscale and Functional Materials. *Accounts of Chemical Research Acc.* Chem. Res. 2014, 47, 2299-2308; Wagle, D. V.; Zhao, H.; Baker, G. A. Deep Eutectic Solvents: Sustainable Media For Nanoscale and Functional Materials. *Accounts of Chemical Research Acc. Chem. Res.* 2014, 47, 2299-2308; and Zhang, Q. et al., Deep Eutectic Solvents: Syntheses, Properties and Applications. *Chem. Soc. Rev.* 2012, 41, 7108.

In some embodiments, the deep eutectic solvents described herein for use in firefighting foams include at least one hydrogen bond donor and at least one hydrogen bond acceptor. In some embodiments, the deep eutectic solvent includes a Lewis acid or a Lewis base. Thus, useful deep eutectic solvents described herein may include a cation, anion, zwitterion, neutral compound and combinations thereof.

In some embodiments, the deep eutectic solvents include an organic acid. The organic acid may be any mono- di- or tri-carboxylic acid or salt thereof. In some embodiments, the carboxylic acid contains between 2 and 30 carbon atoms. In some embodiments, the carboxylic acid contains between 2 and 10 carbon atoms. In some embodiments, the carboxylic acid contains between 2 and 5 carbon atoms. Carboxylic acids are of the general formula RC(O)OH, where R is suitable substituent selected from a hydrogen atom or a substituted or unsubstituted alkyl, cycloalkyl, alkenyl, alkynyl or aryl groups. In some embodiments, the organic acid is an aromatic acid. In some embodiments, the organic acid is an aliphatic acid. Exemplary and non-limiting organic acids include malic acid, maleic acid, malonic acid, citric acid, lactic acid, pyruvic acid, fumaric acid, succinic acid, itaconic acid, levulinic acid, glycolic acid, glutaric acid, phenylpropionic acid, phenylacetic acid, acetic acid, aconitic acid, tartaric acid, ascorbic acid, oxalic acid, glucuronic acid, neuraminic acid, phytic acid, or sialic acid, or a combination thereof.

In some embodiments, the deep eutectic solvents include an amide containing compound. In some embodiments, the deep eutectic solvents include a carbamide. Amides are of the general formula $R^1_nE(O)_xNR^2R^3$, where $R^2$, and $R^3$ is selected from a hydrogen atom or substituted or unsubstituted alkyl, cycloalkyl, alkenyl, alkynyl or aryl alkyl groups; E is selected from a carbon, sulfur, or phosphorus atom; and x is 1 or 2. Carbamides are of the general formula $(R^1)NC(O)NR^2R^3$, where $R^1$, $R^2$, and $R^3$ are any suitable substituent selected from a hydrogen atom or a substituted or unsubstituted alkyl, cycloalkyl, alkenyl, alkynyl or aryl groups. Exemplary and non-limiting amides and carbamides include urea, methylurea, acetamide, or methylacetamide.

In some embodiments, the deep eutectic solvents include an azole. Exemplary and non-limiting azole containing compounds include a pyrazole, imidazole, thiazole, oxazole, or an isoxazole moiety.

In some embodiments, the deep eutectic solvents include an alcohol. The alcohol is any organic compound, which contains one or more hydroxyl (—OH) functional group(s). For example, the alcohol may be any mono-, di-, or tri-ol containing compound. In some embodiments, the alcohol is a sugar alcohol. Exemplary and non-limiting alcohols and sugar alcohols include mannitol, sorbitol, inositol, isosorbide, xylitol, ribitol, galactitol, erythritol, or adonitol or a combination thereof.

In some embodiments, the deep eutectic solvents include a sugar. In some embodiments, the sugar is a monosaccharide. In some embodiments, the sugar is a disaccharide, or an oligosaccharide. Exemplary and non-limiting sugars include sucrose, glucose, fructose, lactose, maltose, cellobiose, arabinose, ribose, ribulose, galactose, rhamnose, raffinose, xylose, mannose, trehalose or a combination thereof.

In some embodiments, the deep eutectic solvents include an amino acid. The amino acid may be any naturally occurring or non-naturally occurring amino acid. For example, the amino acid may be an alpha- (α-), beta- (β-), gamma- (γ-) or delta- (δ-) amino acid. Exemplary and non-limiting amino acids include γ-amino butyric acid, alanine, β-alanine, glutamic acid, aspartic acid, asparagine, lysine, arginine, proline, or threonine, or a combination thereof.

In some embodiments, the deep eutectic solvents include a betaine. In some embodiments, the deep eutectic solvents include an alkyl betaine. In some embodiments, the deep eutectic solvents include an amido betaine. In some embodiments, the deep eutectic solvents include a sulfobetaine or an alkyl sulfobetaine. Betaines are generally zwitterions, which contain a cationic functional group, such as a quaternary ammonium or phosphonium cation and a negatively charged functional group, such as a carboxylate group or a sulfate group. For example, useful betaines described herein are of the general formula $(R^1)(R^2)(R^3)E^+(CH_2)_nX(O)_pO^-$, where $R^1$, $R^2$, and $R^3$ are independently any suitable substituent selected from a hydrogen atom or a substituted or unsubstituted alkyl, amido, cycloalkyl, alkenyl, alkynyl or aryl groups; E is a nitrogen or phosphorus atom, X is a carbon atom or a sulfur atom; n is an integer between 1 and 5; and p is 1 or 2. In some embodiments, the betaine is trimethylglycine.

In some embodiments, the deep eutectic solvents include a quaternary cation. Quaternary cations are permanently positively charged and are of the general formula $E^+(R^1)(R^2)(R^3)(R^4)$, where E is a nitrogen atom or a phosphorus atom and $R^1$,$R^2$,$R^3$, and $R^4$, are any suitable substituent selected from a hydrogen atom or a substituted or unsubstituted alkyl, amido, cycloalkyl, alkenyl, alkynyl or aryl groups. In some embodiments the deep eutectic solvents include quaternary ammonium salt. In some embodiments the deep eutectic solvents include a quaternary phosphonium salt. In some embodiments the salt is a halide salt. In some embodiments the halide salt is selected from chlorine and bromine. Exemplary and non-limiting quaternary ammonium and phosphonium salts include N-ethyl-2-hydroxy-N,N-dimethylethanaminium, ethyl ammonium, 2-chloro-N,N,N-trimethylethanaminium, 2-fluoro-N,N,N-trimethylethanaminium, tetrabutylammonium, tetrapropylammonium, N,N-diethylethanolammonium, N,N,N-trimethyl(phenyl)methanaminium, N-benzyl-2-hydroxy-N-(2-hydroxyethyl)-N-methylethanaminium, 2-(acetyloxy)-N,N,N-trimethylethanaminium, 1-butyl-3-methylimidazolium, benzyltriphenylphosphonium, or methyltriphenylphosphonium or a combination thereof.

In some embodiments, the deep eutectic solvent includes a combination of any of the forgoing compounds described herein. For example, the deep eutectic solvent may include 1, 2, 3, 4, 5, or even 6 or more of the compounds described herein. In some embodiments, the deep eutectic solvent includes a first compound and a second compound. In some embodiments, the deep eutectic solvent includes a first compound, a second compound, and a third compound.

In one embodiment, the deep eutectic solvent includes a first compound selected from a quaternary ammonium salt and a second compound selected from an organic acid, an amino acid, a sugar, and a sugar alcohol. In another embodiment, the deep eutectic solvent includes a first compound selected from an organic acid and a second compound selected from a sugar and a sugar alcohol.

In another embodiment, the deep eutectic solvent includes a first compound selected from a sugar and a sugar alcohol and a second compound selected from a different sugar and a different sugar alcohol.

In another embodiment, the deep eutectic solvent includes a first compound selected from an amino acid and a second compound selected from a sugar and a sugar alcohol.

In another embodiment, the deep eutectic solvent includes a first compound selected from a betaine and a second compound selected from an organic acid and an amino acid.

In another embodiment, the deep eutectic solvent includes a first compound selected from a quaternary ammonium salt and a second compound selected from an organic acid and a third compound selected from an amino acid.

In another embodiment, the deep eutectic solvent includes a first compound selected from a sugar and a sugar alcohol, a second compound selected from a sugar and a sugar alcohol, and a third compound selected from a sugar and a sugar alcohol, where the first, second, and third compounds cannot be the same.

In another embodiment, the deep eutectic solvent includes a first compound selected from an organic acid and an amino acid, a second compound selected from a sugar and a sugar alcohol, and a third compound selected from a sugar and a sugar alcohol, where the second and third compounds cannot be the same.

In some embodiments, the ratio of the first compound to the second compound in the deep eutectic solvent ranges from about 1:30 to about 30:1, including each integer within the specified range. In some embodiments, the ratio between the first compound and the second compound ranges from about 1:15 to about 15:1, including each integer within the specified range. In some embodiments, the ratio between the first compound and the second compound ranges from about 1:10 to about 10:1, including each integer within the specified range. In some embodiments, the ratio between the first compound and the second compound ranges from about 1:5 to about 5:1, including each integer within the specified range. In some embodiments, the ratio between the first compound and the second compound is about 15:1, about 13:1, about 11:1, about 9:1, about 7:1, about 5:1, about 3:1, about 1:1, about 1:3, about 1:5, about 1:7, about 1:9, about 1:11, about 1:13, or about 1:15.

In some embodiments, the ratio of the second compound to the third compound in the deep eutectic solvent ranges from about 1:30 to about 30:1, including each integer within the specified range. In some embodiments, the ratio between the second compound and the third compound ranges from about 1:15 to about 15:1, including each integer within the specified range. In some embodiments, the ratio between the second compound and the third compound ranges from about 1:10 to about 10:1, including each integer within the specified range. In some embodiments, the ratio between the second compound and the third compound ranges from about 1:5 to about 5:1, including each integer within the specified range. In some embodiments, the ratio between the second compound and the third compound is about 15:1, about 13:1, about 11:1, about 9:1, about 7:1, about 5:1, about 3:1, about 1:1, about 1:3, about 1:5, about 1:7, about 1:9, about 1:11, about 1:13, or about 1:15.

In some embodiments, the ratio of the first compound to the second compound to the third compound in the deep eutectic solvent ranges from about 1:1:1 to about 15:1:1, including each integer within the specified range. In some embodiments the ratio of the first compound to the second compound to the third compound is 1:1:1. In some embodiments the ratio of the first compound to the second compound to the third compound is 2:1:1. In some embodiments the ratio of the first compound to the second compound to the third compound is 9:1:1.

In some embodiments, the deep eutectic solvent includes a combination of any of the exemplary and non-limiting compounds shown in Table 1.

TABLE 1

Exemplary All-Natural Solvent Systems

| Component 1 | Component 2 | Component 3 | Molar Ratio |
|---|---|---|---|
| Choline Chloride | Lactic Acid | | 1:1 |
| Choline Chloride | Malonic Acid | | 1:1 |
| Choline Chloride | Maleic Acid | | 1:1 |
| Choline Chloride | DL-Malic Acid | | 1:1 |
| Choline Chloride | Citric Acid | | 1:1 |
| Choline Chloride | Aconitic Acid | | 1:1 |
| Choline Chloride | L-(+)-Tartaric Acid | | 2:1 |
| Choline Chloride | Glycol | | 1:1 |
| Choline Chloride | 1,2-Propanediol | | 1:1 |
| Choline Chloride | 1,2-Propanediol | | 2:1 |
| Choline Chloride | Glycerol | | 1:1 |
| Choline Chloride | meso-Erythritol | | 2:1 |
| Choline Chloride | Xylitol | | 5:2 |
| Choline Chloride | Adonitol | | 5:2 |
| Choline Chloride | Ribitol | | 5:2 |
| Choline Chloride | D-Sorbitol | | 3:1 |
| Choline Chloride | D-Xylose | | 2:1 |
| Choline Chloride | A-L-Rhamnose | | 2:1 |
| Choline Chloride | D-(+)Glucose | | 1:1 |
| Choline Chloride | D(−)-Fructose | | 1:1 |
| Choline Chloride | Sorbose | | 5:2 |
| Choline Chloride | D-Mannose | | 5:2 |
| Choline Chloride | D-(+)-Galactose | | 5:2 |
| Choline Chloride | Sucrose | | 4:1 |
| Choline Chloride | D-(+)-Trehalose | | 4:1 |
| Choline Chloride | Maltose | | 4:1 |
| Choline Chloride | Raffinose | | 11:2 |
| Choline Chloride | Proline | DL-Malic Acid | 1:1:1 |
| Choline Chloride | Xylitol | DL-Malic Acid | 1:1:1 |
| Betaine (trimethylglycine) | Sucrose | | 2:1 |
| Betaine (trimethylglycine) | D-(+)-Trehalose | | 4:1 |
| Betaine (trimethylglycine) | D-Sorbitol | | 3:1 |
| Betaine (trimethylglycine) | DL-Malic Acid | | 1:1 |
| Betaine (trimethylglycine) | L-(+)-Tartaric Acid | | 2:1 |
| Betaine (trimethylglycine) | D-Mannose | | 5:2 |
| Betaine (trimethylglycine) | Inositol | Raffinose | 9:1:1 |
| Betaine (trimethylglycine) | Sucrose | Proline | 1:1:1 |
| Betaine (trimethylglycine) | D-(+)Glucose | Proline | 1:1:1 |
| Betaine (trimethylglycine) | DL-Malic Acid | D-(+)Glucose | 1:1:1 |
| Betaine (trimethylglycine) | DL-Malic Acid | Proline | 1:1:1 |
| Betaine (trimethylglycine) | DL-Malic Acid | Inositol | 1:1:1 |
| Betaine (trimethylglycine) | Oxalic Acid | D-(+)Glucose | 1:1:1 |
| Betaine (trimethylglycine) | Citric Acid | | 1:1 |
| Lactic Acid | D-(+)Glucose | | 5:1 |
| Lactic Acid | $^{\beta}$-Alanine | | 1:1 |
| DL-Malic Acid | D-Xylose | | 1:1 |
| DL-Malic Acid | D-(+)Glucose | | 1:1 |
| DL-Malic Acid | Sucrose | | 1:1 |
| DL-Malic Acid | D-(−)-Fructose | | 1:1 |
| DL-Malic Acid | D-Mannose | | 1:1 |
| DL-Malic Acid | Maltose | | 2:1 |
| DL-Malic Acid | D-(+)-Trehalose | | 2:1 |
| DL-Malic Acid | Lactose | | 2:1 |
| DL-Malic Acid | Raffinose | | 3:1 |
| DL-Malic Acid | Xylitol | | 1:1 |
| DL-Malic Acid | Adonitol | | 1:1 |

TABLE 1-continued

Exemplary All-Natural Solvent Systems

| Component 1 | Component 2 | Component 3 | Molar Ratio |
|---|---|---|---|
| DL-Malic Acid | D-Sorbitol | | 1:1 |
| DL-Malic Acid | D-(+)Glucose | D-(−)-Fructose | 1:1:1 |
| DL-Malic Acid | D-(+)Glucose | Glycerol | 1:1:1 |
| DL-Malic Acid | Sucrose | Glycerol | 1:1:2 |
| DL-Malic Acid | L-Proline | Choline Chloride | 1:1:1 |
| Citric Acid | D-Xylose | | 1:1 |
| Citric Acid | D-(−)-Fructose | | 1:1 |
| Citric Acid | Sorbose | | 1:1 |
| Citric Acid | D-Mannose | | 1:1 |
| Citric Acid | D-(+)Glucose | | 1:1 |
| Citric Acid | Sucrose | | 1:1 |
| Citric Acid | Maltose | | 2:1 |
| Citric Acid | D-(+)-Trehalose | | 2:1 |
| Citric Acid | Raffinose | | 3:1 |
| Citric Acid | D-Sorbitol | | 1:1 |
| Citric Acid | Ribitol | | 1:1 |
| Citric Acid | Xylitol | | 1:1 |
| Citric Acid | Adonitol | | 1:1 |
| Citric Acid | L-Proline | | 1:1 |
| Citric Acid | DL-Malic Acid | | 1:1 |
| Phytic Acid Sodium | Betaine | | 1:6 |
| Phytic Acid Sodium | DL-Malic Acid | | 1:6 |
| Phytic Acid Sodium | Glycerol | | 1:6 |
| Phytic Acid Sodium | L-Proline | | 1:6 |
| Phytic Acid Sodium | D-(+)Glucose | | 1:6 |
| Phytic Acid Sodium | Choline Chloride | | 1:3 |
| D/L-Proline | Sucrose | | 2:1 |
| D/L-Proline | D-Sorbitol | | 1:1 |
| D/L-Proline | D-(+)Glucose | | 1:1 |
| D/L-Proline | Lactic Acid | | 1:1 |
| D/L-Proline | DL-Malic Acid | | 1:1 |
| D/L-Proline | Citric Acid | | 1:1 |
| D/L-Proline | Malonic Acid | | 1:1 |
| L-Serine | DL-Malic Acid | | 3:2 |
| L-Serine | D-(+)Glucose | | 5:4 |
| L-Glutamic Salt | Sucrose | | 2:1 |
| L-Glutamic Salt | D-(+)Glucose | | 1:1 |
| D-(+)Glucose | DL-Malic Acid | | 1:1 |
| D-(+)Glucose | Citric Acid | | 1:1 |
| D-(+)Glucose | L-(+)-Tartaric Acid | | 1:1 |
| D-(+)Glucose | D-(−)-Fructose | Sucrose | 1:1:1 |
| D-(−)-Fructose | Sucrose | | 1:1 |
| $^{\beta}$-Alanine | DL-Malic Acid | | 3:2 |
| $^{\beta}$-Alanine | Citric Acid | | 1:1 |

In some embodiments, the deep eutectic solvents include water. Water may be used to adjust the viscosity of the deep eutectic solvent and tailor the solvent for better dissolving compounds (e.g., biosaccharides in a fire fighting foam); see also, Dai, Y.; Witkamp, G.-J.; Verpoorte, R.; Choi, Y. H. Tailoring Properties of Natural Deep Eutectic Solvents with Water to Facilitate Their Applications. *Food Chemistry*. 2015, 187, 14-19. Without wishing to be bound by any theory, it is currently believed that water in the deep eutectic solvent modulates the hydrogen bonding forces between the eutectic components. The disruption of these hydrogen bonding forces may reduce the viscosity of the deep eutectic solvent and/or modulate its solvent characteristics.

Therefore, in some embodiments, the deep eutectic solvents include about 5% to about 75% water. In some embodiments, the deep eutectic solvents include about 5% to about 60% water. In some embodiments, the deep eutectic solvents include about 5% to about 40% water. In some embodiments, the deep eutectic solvents include about 5% to about 20% water. In some embodiments, the deep eutectic solvents include about 5% to about 10% water. In some embodiments, the deep eutectic solvents include about 5%, about 10%, about 15%, about 20%, about 25%, about 30%, about 35%, about 40%, about 45%, about 50%, about 55%, about 60%, about 65%, about 70%, or about 75% water.

In some embodiments, the deep eutectic solvent has a low, medium, or high viscosity. In some embodiments, the low viscosity deep eutectic solvents may be used in AFFF foams and the high viscosity deep eutectic solvents may be used in fluorine free foams.

In some embodiments, deep eutectic solvents may be used as a surrogate foam or as a component of a surrogate foam for annual fire fighting testing. In some embodiments, the low viscosity deep eutectic solvents may be used as a model of AFFF foams and the high viscosity deep eutectic solvents may be used as a model of fluorine free foams.

In some embodiments, the deep eutectic solvent has a viscosity of about 10 cps to about 10,000 cps, including each integer within the specified range. In some embodiments, the deep eutectic solvent has a viscosity of about 10 cps to about 8,000 cps including each integer within the specified range. In some embodiments, the deep eutectic solvent has a viscosity of about 10 cps to about 6,000 cps, including each integer within the specified range. In some embodiments, the deep eutectic solvent has a viscosity of about 10 cps to about 4,000 cps, including each integer within the specified range. In some embodiments, the deep eutectic solvent has a viscosity of about 10 cps to about 2,000 cps, including each integer within the specified range. In some embodiments, the deep eutectic solvent has a viscosity of about 10 cps to about 1,000 cps, including each integer within the specified range. In some embodiments, the deep eutectic solvent has a viscosity of about 10 cps to about 500 cps, including each integer within the specified range. In some embodiments, the deep eutectic solvent has a viscosity of about 10 cps, about 100 cps, about 200 cps, about 300 cps, about 400 cps, about 500 cps, about 600 cps, about 700 cps, about 800 cps, about 900 cps, about 1000 cps, about 1500 cps, about 2000 cps, about 2500 cps, about 3000 cps, about 3500 cps, about 4000 cps, about 4500 cps, about 5000 cps, about 5500 cps, about 6000 cps, about 6500 cps, about 7000 cps, about 7500 cps, about 8000 cps, about 8500 cps, about 9000 cps, about 9500 cps, or about 10000 cps.

In some embodiments, the deep eutectic solvents have a melting point of about −60° C. to about 20° C., including each integer within the specified range. In some embodiments, the deep eutectic solvents have a melting point of about −40° C. to about 5° C., including each integer within the specified range. In some embodiments, the deep eutectic solvents have a melting point of about −20° C. to about 5° C., including each integer within the specified range. In some embodiments, the deep eutectic solvents have a melting point of about −10° C. to about 5° C., including each integer within the specified range.

In some embodiments, the deep eutectic solvents have a freezing point of about −60° C. to about 20° C., including each integer within the specified range. In some embodiments, the deep eutectic solvents have a freezing point of about −40° C. to about 5° C., including each integer within the specified range. In some embodiments, the deep eutectic solvents have a freezing point of about −20° C. to about 5° C., including each integer within the specified range. In some embodiments, the deep eutectic solvents have a freezing point of about −10° C. to about 5° C., including each integer within the specified range.

Firefighting Foams Including Deep Eutectic Solvents

In some embodiments, the eutectic solvents are sourced from food quality ingredients and substituted into wetting agents and fluorine free fluids for use in a firefighting foam composition.

Therefore, the deep eutectic solvents are used in firefighting foam compositions or in alternative embodiments, the deep eutectic solvents are used in surrogate firefighting foam compositions. The deep eutectic solvent may constitute a majority or minority of the foam composition or surrogate foam composition. In some embodiments, firefighting foams and surrogate firefighting foam compositions include about 5% to about 95% of a deep eutectic solvent described herein. In some embodiments, firefighting foams and surrogate firefighting foam compositions include about 5% to about 80% of a deep eutectic solvent described herein. In some embodiments, firefighting foams and surrogate firefighting foam compositions include about 5% to about 60% of a deep eutectic solvent described herein. In some embodiments, firefighting foams and surrogate firefighting foam compositions include about 5% to about 40% of a deep eutectic solvent described herein. In some embodiments, firefighting foams and surrogate firefighting foam compositions include about 5% to about 20% of a deep eutectic solvent described herein. In some embodiments, firefighting foams and surrogate firefighting foam compositions include about 1%, about 5%, about 10%, about 15%, about 20%, about 25%, about 30%, about 35%, about 40%, about 45%, about 50%, about 55%, about 60%, about 65%, about 70%, about 75%, about 80%, about 85%, about 90%, about 95%, or even 100% of a deep eutectic solvent described herein.

The fire foam compositions including a deep eutectic solvent described herein may be an aqueous film forming foam (AFFF), alcohol resistant film forming foam (AR-AFFF), or any fluorine-free firefighting foam. These fire foams may be present as a concentrated composition. The concentrates may be produced at any suitable strength, including, but not limited to, 1%, 3%, and 6% (w/w) foam concentrates, which are concentrations that are typical for commercial use. Concentrates that are less than 1% (w/w) or greater than 6% (w/w) also may be prepared. The foam concentrates are mixed with water, which may include pure, deionized or distilled water, tap or fresh water, sea water, brine, or an aqueous or water-containing solution or mixture capable of serving as a water component for the firefighting foam composition.

In some embodiments, the deep eutectic solvents promote the solubility of one or more components of a fire foam composition described herein. In some embodiments, the deep eutectic solvents promote the solubility of fire foam polymers and biopolymers described herein. In some embodiments, the deep eutectic solvents promote the solubility of fire foam biopolymer saccharides described herein. Exemplary and non-limiting biopolymer saccharides include chitin, chitosan, dextran, maltodextrin, gums, such as diutan gum, xanthan gum, rhamsan gum and the like, agar, or alginates or combinations thereof.

Conventional AFFF concentrates contain mixtures of perfluoroalkyl and non-fluorinated hydrocarbon surfactants, each of which may be anionic, cationic, nonionic or amphoteric, solvents such as glycols and/or glycol ethers, and minor additives such as chelating agents, pH buffers, corrosion inhibitors and the like. Various conventional AFFF concentrates are described in, for example, U.S. Pat. Nos. 3,047,619; 3,257,407; 3,258,423; 3,562,156; 3,621,059; 3,655,555; 3,661,776; 3,677,347; 3,759,981; 3,772,199; 3,789,265; 3,828,085; 3,839,425; 3,849,315; 3,941,708; 3,95,075; 3,957,657; 3,957,658; 3,963,776; 4,038,198; 4,042,522; 4,049,556; 4,060,132; 4,060,489; 4,069,158; 4,090,976; 4,099,574; 4,149,599; 4,203,850; 4,209,407; and 8,431,036 each of which is incorporated by reference herein. AR-AFFF concentrates are described in, for example, U.S. Pat. Nos. 4,060,489; 4,149,599 and 4,387,032, each of which is incorporated by reference herein.

In contrast to the conventional fire foams mentioned above, the fire foam compositions described herein have little to no fluorine or fluorosurfactants. Thus, in some embodiments, the firefighting foam compositions described herein have less than 5% by weight of fluorine. In some aspects, the firefighting foam compositions described herein have less than 1% by weight of fluorine. In some aspects, the firefighting foam compositions described herein have less than 0.5% by weight of fluorine. In some aspects, the firefighting foam compositions described are free of fluorine.

In some embodiments, the firefighting foam compositions described herein have less than 5% by weight of fluorinated surfactants. In some aspects, firefighting foam compositions described herein have less than 1% by weight of fluorinated surfactants. In some aspects, firefighting foam compositions described herein have less than 0.5% by weight of fluorinated surfactants. In some aspects, the firefighting foam compositions described are substantially free of fluorinated surfactants.

In some embodiments, the firefighting foams having a deep eutectic solvent also include one or more ingredients that are sourced from the food industry. In some embodiments, the firefighting foams include one or more additional firefighting foam components dissolved, dispersed, or suspended in the deep eutectic solvent including one or more surfactants, one or more additional solvents, one or more electrolytes, one or more foam stabilizers, one or more film formers, one or more corrosion inhibitors, or one or more antimicrobials, or a combination thereof. In some embodiments, the one or more additional firefighting foam components are suspended in the deep eutectic solvent. In some embodiments, the one or more additional firefighting foam components are dispersed in the deep eutectic solvent. In some embodiments, the one or more additional firefighting foam components are dissolved in the deep eutectic solvent.

In some embodiments, the firefighting foams as described herein have a composition as shown in Table 2.

TABLE 2

Exemplary firefighting foam composition

| Ingredient | Percent by weight |
|---|---|
| Deep eutectic solvent | 5-100 |
| Zwitterionic surfactant | 0-40 |
| Nonionic surfactant | 0-40 |
| Anionic surfactant | 0-40 |
| Foam stabilizer/foam aid | 0-15 |
| Water miscible solvent | 0-15 |
| Corrosion inhibitor | 0-5 |
| Film formers/thickeners | 0-10 |
| Antimicrobials/biocides | 0-0.05 |
| Electrolytes | 0-5 |
| Water | to 100% |

As described herein, the firefighting foam concentrates may be formulated at different concentrations, for example from 1% to 6%. As used herein, the lowest percent concentrate indicates the most concentrated foam composition. Thus, a 1% concentrate solution as a use strength pre-mix is formed after mixing 1 part of concentrate (e.g., a concentrate of Table 2) with 99 parts of water and a 6% use strength pre-mix solution is formed after mixing 6 parts of the concentrate (e.g., a concentrate of Table 2) with 94 parts of water. The water used in the firefighting foam compositions and for diluting a foam concentration to use strength may include pure, deionized or distilled water, tap or fresh water, sea water, brine, or an aqueous or water-containing solution or mixture capable of serving as a water component.

The concentration strength may be increased or decreased. For example, to prepare a 1% concentrate solution from a 3% concentrate solution, the weight amount of each agent in the firefighting foam composition concentrate would be increased by a factor of 3. Alternatively, to prepare a 3% concentrate solution from a 1% concentrate solution, the weight of each agent would be decreased by a factor of 3.

In some embodiments, the firefighting foams as described herein have a composition as shown in Table 3.

TABLE 3

Exemplary firefighting foam composition

| Ingredient | Percent by weight (Wt %) |
|---|---|
| NADES (Fructose, Glucose, Sucrose) | 20 |
| Nonionic surfactant 1 (Q-NATURALE ®) | 1 |
| Nonionic surfactant 2 (APG 325 N) | 25 |
| Film former 1 (BT Xanthan Gum) | 1.2 |
| Film former 2 (Rhamsan Gum) | 1.2 |
| Water | 51.6 |
| Total | 100 |

In some embodiments described herein, the fire foam compositions contain additional hydrocarbon surfactants. These surfactants help promote foam formation of the fire foam following aeration. The use of additional surfactants also functions to promote foam spreading, drainage, fluidity, and expansion. In addition, the use of surfactants may aid in the solubilization of other components in hard water, sea water or brine solutions. The additional hydrocarbon surfactant may be anionic, zwitterionic/amphoteric, or cationic having a linear carbon chain of about 6 to 20 carbon atoms. In the present context, the reference to surfactants of different charge types refers to, for example, anionic and nonionic surfactants, or anionic and zwitterionic surfactants.

Exemplary and non-limiting zwitterionic or amphoteric hydrocarbon surfactants include, but are not limited to, those which contain in the same molecule, amino and carboxy, sulfonic, and sulfuric ester moieties, such as amine oxides, aminopropionates, sultaines, sulfobetaines, alkyl sulfobetaines, alkyl betaines, alkylamidobetaines, dihydroxyethyl glycinates, imadazoline acetates, imidazoline propionates, and imidazoline sulfonates. Commercially available products include Chembetaine CAS (Lubrizol Inc.), Mirataine™ H2C-HA (sodium laurimino dipropionate), Miranol™ C2M-SF Conc. (sodium cocoampho propionate), Mirataine™ CB (cocamidopropyl betaine), Mirataine™ CBS (cocamidopropyl hydroxysultaine), and Miranol™ JS Conc. (sodium caprylampho hydroxypropyl sultaine), all commercially available from Rhone-Poulenc Corp.; imidazole-based surfactants are described in U.S. Pat. No. 3,957,657, which is incorporated by reference herein for its teachings thereof. In some aspects, the zwitterionic surfactant includes an alkyl sulfobetaine.

Exemplary and non-limiting anionic hydrocarbon surfactants include, but are not limited to, $C_8$-$C_{16}$ alkyl surfactants, alkyl carboxylates, alkyl sulfates, sulfonates, and their ethoxylated derivatives. Examples of alkyl sulfates include but are not limited to sodium octyl sulfate (e.g., Sipex™ OLS, commercially available from Rhone-Poulenc Corp., Cranberry, N.J.) and sodium decyl sulfate (e.g., Polystep™ B-25, commercially available from Stepan Co., Northfield, Ill.); alkyl ether sulfates such as $C_nH_{2n-1}(OC_2H_4)_2OSO_3Na$, wherein $6 \leq n \leq 12$ (e.g., Witcolate™ 7093, commercially available from Witco Corp., Chicago, Ill.); and alkyl sulfonates such as $C_nH_{2n+1}SO_3Na$, wherein $6 \leq n \leq 12$. Additional alkali metal and ammonium salts are suitable. In some aspects, the one or more anionic hydrocarbon surfactants includes decyl sulfate.

Suitable nonionic surfactants include, but are not limited to, polyoxyethylene derivatives of alkylphenols, linear or branched alcohols, fatty acids, alkylamines, alkylamides, and acetylenic glycols, alkyl glycosides and alkyl polyglycosides available as, for example, APG 325N (DeWolf Chemical), block polymers of polyoxyethylene and polyoxypropylene units. The nonionic surfactant may also include compounds, which are sourced from all-natural sources, such as a saponins extracted from the quillaja tree, commercially available as Q-NATURALE® (Ingredion™). Additional nonionic surfactants are described in U.S. Pat. No. 5,207,932, which is incorporated by reference herein. In some embodiments, the nonionic surfactant is an alkyl polyglycoside (e.g., APG 325N).

In some embodiments, the firefighting foams include a water-soluble polymeric film formers or thickeners. In some aspects, these film formers or thickeners are suitable for AR-AFFF concentrates for extinguishing fires involving polar solvents or fuels. These film formers precipitate from solution when the foam bubbles come into contact with the polar solvents and fuel and form a vapor-repelling polymer film at the solvent/foam interface, preventing foam collapse. Examples of suitable compounds include thixotropic polysaccharide gums as described in U.S. Pat. Nos. 3,957,657; 4,060,132; 4,060,489; 4,306,979; 4,387,032; 4,420,434; 4,424,133; 4,464,267, 5,218,021, and 5,750,043, 6,262,128, and 7,868,167 each of which are incorporated by reference herein.

Exemplary and non-limiting commercially available film forming compounds are marketed as Rhodopol, Keltrol, Kelco, Actigum, Cecal-gum, Galaxy, and Kelzan. Additional exemplary gums and resins useful as film formers include a brine tolerant gum (BT-Gum), acidic gums such as xanthan gum (e.g., BT-xanthan gum), diutan gum, pectic acid, alginic acid, agar, carrageenan gum, rhamsam gum, welan gum, mannan gum, locust bean gum, galactomannan gum, pectin, starch, bacterial alginic acid, succinoglucan, gum arabic, carboxymethylcellulose, heparin, phosphoric acid polysaccharide gums, dextran sulfate, dermantan sulfate, fucan sulfate, gum karaya, gum tragacanth and sulfated locust bean gum. Exemplary and non-limiting neutral polysaccharides useful as film formers include: cellulose, hydroxyethyl cellulose, dextran and modified dextrans, neutral glucans, hydroxypropyl cellulose, as well, as other cellulose ethers and esters. Modified starches include starch esters, ethers, oxidized starches, and enzymatically digested starches. In some aspects, the one or more film forming compounds includes diutan gum.

Foam aids may be used to enhance foam expansion and drain properties, while providing solubilization and anti-freeze action. Exemplary and non-limiting foam aids include alcohols or ethers such as ethylene glycol monoalkyl ethers, polyethylene glycol, diethylene glycol monoalkyl ethers, propylene glycol, dipropylene glycol monoalkyl ethers, triethylene glycol monoalkyl ethers, 1-butoxyethoxy-2-propanol, glycerine, hexylene glycol, and trimethylglycine. Useful foam aids are known, see, for example, in U.S. Pat. Nos. 5,616,273, 3,457,172; 3,422,011 and 3,579,446, and in PCT International Application Pub. No. WO 2014/153140 each of which is incorporated by reference herein. In some aspects, the one or more foam aids includes propylene glycol.

In some embodiments, the firefighting foams include one or more chelators or sequestering buffer. Exemplary and non-limiting chelators and sequestering buffers include agents that sequester and chelate metal ions, including polyaminopolycarboxylic acids, ethylenediaminetetraacetic acid, citric acid, tartaric acid, nitrilotriacetic acid, hydroxyethylethylenediaminetriacetic acid and salts thereof. Exemplary buffers include Sorensen's phosphate or McIlvaine's citrate buffers.

In some embodiments, the firefighting foams include one or more corrosion inhibitors. Exemplary and non-limiting corrosion inhibitor includes ortho-phenylphenol, tolyltriazole, and phosphate ester acids. In some aspects, the corrosion inhibitor is tolyltriazole.

In some embodiments, the firefighting foams include one or more electrolytes. An electrolyte present in small quantities may balance the performance of fire foam agents when mixed with water ranging from soft to very hard, including sea water or brine, and to improve agent performance in very soft water. Typical electrolytes include salts of monovalent or polyvalent metals of Groups 1, 2, or 3, or organic bases. Exemplary and non-limiting alkali metals useful in the fire foam compositions described herein are sodium, potassium, or magnesium. Exemplary and non-limiting organic bases include ammonium, trialkylammonium, bis-ammonium salts and the like. Additional electrolytes include, but are not limited to sulfates, bisulfates, phosphates, nitrates and polyvalent salts including magnesium sulfate and magnesium nitrate. In some aspects, the electrolyte is magnesium sulfate.

In some embodiments, the firefighting foam includes one or more antimicrobial, biocidal, or preservatives. These components are included to prevent the biological decomposition of natural product based polymers that are incorporated as polymeric film formers (e.g., a polysaccharide gum). Examples include Kathon CG/ICP (Rohm & Haas Company), Givgard G-4 40 (Givaudan, Inc.), and Dowicil 75 (Dow Chemical Company). Additional preservatives are disclosed in U.S. Pat. Nos. 3,957,657; 4,060,132; 4,060,489; 4,306,979; 4,387,032; 4,420,434; 4,424,133; 4,464,267, 5,207,932, 5,218,021, and 5,750,043, each of which is incorporated by reference herein. In some aspects, the biocidal agent is Dowicil 75.

In some embodiments, the firefighting foam includes one or more water miscible non-aqueous solvents. Exemplary and non-limiting solvents include hexylene glycol, butyl carbitol, Butyl Cellosolve™, polyethylene glycol, methyl diproxitol, propylene glycol, propylene glycol n-propyl ether, and tripropylene glycol methyl ether. In some aspects, the one or more non-aqueous solvents is propylene glycol. In some aspects, the one or more non-aqueous solvents is butyl carbitol. In some aspects, the one or more non-aqueous solvents is butyl carbitol and propylene glycol.

Methods of Manufacturing Firefighting Foams Having Deep Eutectic Solvents

Some embodiments described herein are methods for manufacturing firefighting foam compositions including a deep eutectic solvent and one or more additional firefighting foam components. In some embodiments, the method includes: a). preparing or providing a specified amount of deep eutectic solvent mixture of two or more ingredients; b). adding a specified amount of a film forming polymer (e.g., one or more biosaccharide gums) and agitating the mixture; and c) adding a specified amount of water.

In some embodiments, the method for manufacturing fire foam compositions including a deep eutectic solvent and one or more additional firefighting foam components includes: a). preparing or providing a specified amount of deep eutectic solvent mixture of two or more ingredients; b). adding a specified amount of film forming polymer (e.g., one or more biosaccharide gums) to the deep eutectic solvent mixture and agitating the mixture; c). adding a specified amount of a first surfactant to the mixture (e.g., a non-ionic surfactant, such as Q-NATURALE®) and agitating the mixture; d). adding a specified amount of a second surfactant (e.g., a non-ionic surfactant, such as APG 325N) and agitating the mixture; and e) adding a specified amount of water.

In some embodiments, the method for manufacturing a fire foam composition further includes adding a specified amount of one or more additional components described herein including one or more surfactants, one or more additional solvents, one or more electrolytes, one or more foam stabilizers, one or more additional film formers, one or more corrosion inhibitors, or one or more antimicrobials, or a combination thereof to a fire foam composition including a deep eutectic solvent and one or more additional firefighting foam components.

The eutectic and deep eutectic solvents described herein may be prepared, for example, by adding a first and a second component and optionally a third component to a reaction vessel and stirring the added components until a homogenous liquid mixture is obtained. The individual compounds forming the eutectic and deep eutectic solvent have a higher melting temperature than the eutectic mixture, but when properly mixed in the proper ratio, the eutectic mixture has a melting temperature lower than any of the compounds alone. The eutectic point of the mixtures may be determined, for example, by varying the concentration of the compounds relative to each other and determining the ratio of components in a mixture that yields the lowest melting point of any ratio of the components of the mixture. This may be done by preparing binary and ternary phase diagrams for each mixture as is known in the art.

During formation of the eutectic mixture, heat may be applied while mixing the components. In addition, the individual compounds may be dissolved in water followed by heating and vacuum evaporation of the water to form the final liquid deep eutectic mixture. Alternatively, if water is desired in the final eutectic mixture composition, the components may be mixed with water while mixing until a homogenous solution is obtained. Methods for forming some deep eutectic solvents and natural deep eutectic solvents are described generally in, for example, Dai, Y. et al., Natural Deep Eutectic Solvents as New Potential Media for Green Technology. *Analytica Chimica Acta.* 2013, 766, 61-68 and Dai, Y. et al., Ionic Liquids and Deep Eutectic Solvents in Natural Products Research: Mixtures of Solids as Extraction Solvents. *J. Nat. Prod. Journal of Natural Products.* 2013, 76, 2162-2173.

Methods of Using Firefighting Foams

Some embodiments described herein are methods of using the firefighting foam compositions described herein to extinguish a fire. The firefighting foam compositions described herein are introduced into a fire or flame in an amount sufficient to extinguish the fire or flame. One skilled in the art will recognize that the amount of extinguishing composition needed to extinguish a particular hazard will depend upon the nature and extent of the hazard. In some aspects, the firefighting foams described herein are used to extinguish a class A fire. In some aspects, the firefighting foams described herein are used to extinguish a class B fire. In some aspects, the firefighting foams described herein are used to extinguish a class C fire. In some aspects, the firefighting foams described herein are used to extinguish a class D fire. In some aspects, the firefighting foams described herein are used to extinguish a class K fire. The fire foam agents and percent weight of the fire foam compositions described herein may be modified to suit the class of fire being extinguished as would be understood by a person of skill in the art.

In some embodiments described herein, the foam composition can be applied to a variety of substrates, including liquid non-polar (e.g., petrol) and polar liquid chemicals. The applied foam spreads quickly as a thick yet mobile blanket over a surface of a liquid chemical, for rapid coverage and/or extinguishment of a fire. In the case of a burning liquid chemical, drainage from the foam composition (i.e., the aqueous phase) drains and spreads as a film over the surface of the liquid chemical. If the film becomes disturbed or broken, it has properties to reform to seal vapors (sometimes existing at elevated temperatures) and prevent ignition or re-ignition of the liquid chemical. The foam compositions described herein remain in the form of a foam blanket over the liquid chemical to provide continued vapor suppression and resistance to ignition or re-ignition (i.e., burnback resistance) of the liquid chemical for a significant time after extinguishment.

In some embodiments, the firefighting foam concentrates described herein are mixed with water to form a use strength formulation. In some aspects, the firefighting foams are mixed as a 3% solution, and foamed using foaming devices well known in the art. As water under pressure passes through a fire hose, typically 3 percent by volume of the concentrate composition is inducted into the hose line by the Venturi effect to form a foam solution of the concentrate diluted with water. The solution becomes aerated to produce a finished foam by use of an air-aspirating nozzle located at the outlet end of the hose. A foam solution stored for any length of time prior to aeration is known as a foam premix and can likewise be aerated to produce a finished foam. Equipment which can be used to produce and apply these aqueous air-foams are known in the art and also are described in publications by the National Fire Protection Association.

In some embodiments, the foaming composition, containing the foam agents as described herein exists as a transitory composition as a flow of water within a fire-fighting foam dispenser (e.g., a fire hose). Therefore, after formation of the foaming composition, the foaming composition can be aerated by methods that are well understood in the art of foam compositions, e.g., using an air-aspirating nozzle, to form a foam composition including a vapor phase (e.g., air) entrained in a liquid phase (e.g., aqueous). The amount of air generally included in the foam can be such that the air will be the major component of the foam by volume, e.g., greater than about 50 percent by volume, for example from about 75 to 98 percent by volume air. In some aspects, the foam for most applications has a density of less than 1 gram per cubic centimeter with a defined expansion rate ratio (volume of expanded foam in relation to the weight of unexpanded foam in grams).

In some embodiments described herein, the firefighting foam has an expansion ratio from about 2 to 1 to about 1000 to 1. In some aspects, the firefighting foam is a low expansion foam having an expansion ratio of about 2 to 1 to about 20 to 1. In some aspects, the firefighting foam is a medium expansion foam having an expansion ratio of about 20 to 1 to about 200 to 1. In some aspects, the firefighting foam is a high expansion foam having an expansion ratio of about 200 to 1 to about 1000 to 1.

In some embodiments, the firefighting foams may be used in place of traditional firefighting foams for annual testing as a surrogate foam. Exemplary and non-limiting surrogate foam applications include field testing, R&D testing, 3rd party approval testing and any other application where the surrogate foams can be used as a replacement for calibration, testing equipment, annual field testing, etc. and conducting preliminary screening of foams in hardware.

It will be apparent to one of ordinary skill in the relevant art that suitable modifications and adaptations to the compositions, formulations, methods, processes, and applications described herein can be made without departing from the scope of any embodiments or aspects thereof. The compositions and methods provided are exemplary and are not intended to limit the scope of any of the specified embodiments. All of the various embodiments, aspects, and options disclosed herein can be combined in any and all variations or iterations. The scope of the compositions, formulations, methods, and processes described herein include all actual or potential combinations of embodiments, aspects, options, examples, and preferences herein described. The exemplary compositions and formulations described herein may omit any component, substitute any component disclosed herein, or include any component disclosed elsewhere herein. The ratios of the mass of any component of any of the compositions or formulations disclosed herein to the mass of any other component in the formulation or to the total mass of the other components in the formulation are hereby disclosed as if they were expressly disclosed. Should the meaning of any terms in any of the patents or publications incorporated by reference conflict with the meaning of the terms used in this disclosure, the meanings of the terms or phrases in this disclosure are controlling. Furthermore, the foregoing discussion discloses and describes merely exemplary embodiments. All patents and publications cited herein are incorporated by reference herein in their entirety.

EXAMPLES

Example 1

Exemplary All Natural Deep Eutectic Solvents for Use in Fire Foam Compositions Exemplary natural deep eutectic solvents (NADES) for use in firefighting foam compositions described herein including a natural deep eutectic solvent ternary mixture of fructose, glucose, and sucrose or a binary mixture of sucrose and fructose were generated (Table 4). These NADES compositions were prepared by mixing the individual components in a beaker with small amounts of water. After a liquid mixture was obtained, the water was evaporated resulting in the final NADES mixture.

TABLE 4

| Exemplary Natural Deep Eutectic Solvent Mixture | | |
|---|---|---|
| Ingredients | F1 (Wt %) | F2 (Wt %) |
| Glucose | 26 | — |
| Fructose | 26 | 34 |
| Sucrose | 49 | 66 |
| Total | 100 | 100 |

Example 2

Exemplary All Natural Deep Eutectic Solvent Fire Foam Compositions

Exemplary firefighting foam compositions including a natural deep eutectic solvent ternary mixture of fructose, glucose, and sucrose according to formulation F1 of Table 4 were generated as shown in Table 5.

TABLE 5

| Exemplary All Natural Deep Eutectic Solvent Fire Foam Composition | | | | |
|---|---|---|---|---|
| Recipe | BT Gum (%) | NADES F1 (%) | Q-Naturale ® (%) | Water (%) |
| 1 | 0.7 | 20 | 5 | 74.3 |
| 2 | 0.7 | 30 | 5 | 64.3 |
| 3 | 0.7 | 40 | 5 | 54.3 |

TABLE 5-continued

| Exemplary All Natural Deep Eutectic Solvent Fire Foam Composition | | | | |
|---|---|---|---|---|
| Recipe | BT Gum (%) | NADES F1 (%) | Q-Naturale ® (%) | Water (%) |
| 4 | 0.7 | 50 | 5 | 44.3 |
| 5 | 0.7 | 60 | 5 | 34.3 |

Example 3

Exemplary AFFF All Natural Deep Eutectic Solvent Fire Foam Compositions

Exemplary firefighting foam compositions including a natural deep eutectic solvent binary mixture of sucrose and fructose according to Table 4 were generated. This NADES composition was then used in several AFFF fire foam compositions according to Table 6.

To maximize performance and mimic a traditional 3% AFFF the following three recipes were generated focusing on foam performance through expansion and drain time (DT) as shown in Table 6. These foams were then tested in a blender foam quality test where 100 grams of the prepared premix (3% diluted in 97% water) was mixed in a blender on low for 60 seconds and then poured out into a graduated cylinder and the results were recorded. These foams were then tested using the NRL nozzle test, which is defined by the military standard for approving AFFF products (MIL-F243858 qualification test); those results are listed in Table 6. In these formulations, the Q-Naturale® is a naturally occurring surfactant that was used to boost foam and remove petroleum base surfactants.

TABLE 6

| Exemplary AFFF All Natural Deep Eutectic Solvent Fire Foam Composition | | | | | |
|---|---|---|---|---|---|
| | Ingredients | | | | |
| Recipe | BT Gum (Wt %) | NADES F2 (Wt %) | Q-Naturale ® (Wt %) | APG (Wt %) | Water (Wt %) |
| 1 | 0.7 | 20 | 5 | 25 | 49.3 |
| 2 | 0.7 | 20 | 1 | 25 | 53.3 |
| 3 | 0.7 | 20 | 3 | 25 | 51.3 |

| Properties of Exemplary AFFF All Natural Deep Eutectic Solvent Fire Foam Compositions | | | | | | | | |
|---|---|---|---|---|---|---|---|---|
| | Blender | Blender | NRL Expansion | | | NRL DT (sec) (25%) | | |
| Recipe | Expansion | DT (25%) | Rep1 | Rep2 | Rep3 | Rep1 | Rep2 | Rep3 |
| 1 | 0.7 | 20 | 6.33 | 3.1 | 6.49 | 325 | 328 | 319 |
| 2 | 0.7 | 20 | 6.1 | 5.87 | 6.02 | 357 | 359 | 367 |
| 3 | 0.7 | 20 | 6.21 | 6.66 | 6.66 | 335 | 334 | 337 |

Example 4

Fire Testing Results of Exemplary All Natural Deep Eutectic Solvent Fire Foam Compositions A firefighting foam containing a deep eutectic solvent was prepared and tested as a fire extinguishing agent. Two different types of gums were added at various loadings to target viscosity and foam quality requirements. The firefighting foams according to recipe 3 of Table 7, a 3×3 surrogate product, which were made with the NADES according to formulation F2, were tested on a UL type 3 heptane fire. This foam extinguished all flames within 3:30 seconds and withstood 2 torch tests and did not reignite. The same surrogate firefighting foam was also tested on the EN1568-4, 4 fire test and controlled the fire within 70 seconds and the burnback resistance lasted for more than 22 minutes.

TABLE 7

Exemplary All Natural Deep Eutectic Solvent Fire Foam Composition

| Recipe | Ingredients | | | | | |
|---|---|---|---|---|---|---|
| | BT Gum (Wt %) | Rhamsan (Wt %) | NADES (F2) (Wt %) | Q-Naturale ® (Wt %) | APG (Wt %) | Water (Wt %) |
| 1 | 0.7 | 0.7 | 20 | 1 | 20 | 57.6 |
| 2 | 1 | 1 | 20 | 1 | 25 | 52 |
| 3 | 1.2 | 1.2 | 20 | 1 | 25 | 51.6 |

Properties of All Natural Deep Eutectic Solvent Fire Foam Compositions

| Recipe | Viscosity (cps) | NRL Expansion | | | NRL DT (seconds) (25%) | | |
|---|---|---|---|---|---|---|---|
| | | Rep1 | Rep2 | Rep3 | Rep1 | Rep2 | Rep3 |
| 1 | 5363.73 | 5.4 | 4.99 | 5.03 | 598 | 660 | 704 |
| 2 | 7474.05 | 4.85 | 5.35 | 4.69 | 1086 | 1081 | 1140 |
| 3 | 9936.09 | 4.93 | 4.81 | 4.59 | 1489 | 1535 | 1518 |

Example 5

Methods of Manufacturing All Natural Deep Eutectic Solvent Fire Foam Compositions The NADES were prepared prior to blending in the remaining components of the foam composition. It was found that first preparing NADES by combining and mixing the sugars (e.g., glucose, fructose, and sucrose) is important in later dispersing the biogums/biopolymers (e.g., BT gum). This allows for the gums to properly hydrate without encapsulating (clumping) upon the addition of the surfactant (Q-Naturale®), AGP, and water.

It was further found that it is important to use the NADES in the correct manufacturing order to impart actual firefighting performance as seen in the UL and EN fire tests. The order of addition into the NADES with appropriate agitation begins with preparing the NADES/Gum slurry. Next the Q-Naturale® is added followed by the APG and the resulting mixture is finally diluted down with water to decrease the viscosity of the preparation. Firefighting foams that were prepared with NADES not following this order resulted in bio gums that were encapsulated but not fully hydrated resulting in foams that were not satisfactory for further fire testing. Thus, in some embodiments, the deep eutectic solvent is important in process order and is used to dissolve other ingredients into the foam concentrate before dilution with any of the other additives used as mentioned in the examples.

Preparing foams with NADES that allow for the proper dispersion of bio gums provides for certain environmental advantages. For example, traditional synthetic firefighting foams are prepared by slurrying the bio gums in butyl carbitol (a SARA Title III section 313 toxic chemical); by switching to NADES, these harmful solvents can be removed from the product and still produce viable firefighting foams.

Example 6

Exemplary Surrogate Fire Foam Compositions

Several exemplary surrogate firefighting foam compositions were generated as shown in Tables 8-9. These stock surrogate foam solutions were prepared to mimic commercially available AFFF products with the specific purpose of using the "surrogate" for annual proportioning testing in systems and commissioning of new systems. Recipe 9 of Table 9 demonstrated the best surrogate foam results compared to reference commercially available firefighting foams based upon regression analysis comparing viscosity versus the concentrations of QNaturale®, APG, and water. The NRL testing results for this surrogate foam is provided in Table 10.

The deep eutectic solvents and natural deep eutectic solvents described herein may also be used in these exemplary surrogate foam compositions. The use of these types of surrogate fire foam compositions is increasingly important due to the damaging effects of foams containing PFOS and PFOA.

TABLE 8

Exemplary Surrogate Firefighting Foam Composition

| Ingredients | Wt % |
|---|---|
| Epsom Salt | 15 |
| Q-Naturale ® | 10 |
| "Glucopon" APG | 16 |
| Diutan | 0.43 |
| Hexylene Glycol | 8 |
| Water | 50.57 |
| Foam Properties | |
| Expansion | 6 (unitless) |
| Drain Time 25% | 5:58 (min:sec) |

TABLE 8-continued

| Exemplary Surrogate Firefighting Foam Composition | |
|---|---|
| Ingredients | Wt % |
| Drain Time 50% | 10:40 (min:sec) |

TABLE 9

Exemplary Surrogate Firefighting Foam Composition

| Recipe | Water (Wt %) | Q-Naturale ® (Wt %) | APG (Wt %) |
|---|---|---|---|
| 1 | 95 | 5 | 0 |
| 2 | 81.7 | 17.8 | 0.5 |
| 3 | 90.9 | 5.3 | 3.8 |
| 4 | 75 | 12.5 | 12.5 |
| 5 | 50 | 40 | 10 |
| 6 | 55.2 | 26 | 18.8 |
| 7 | 50 | 25 | 25 |
| 8 | 25 | 25 | 50 |
| 9 | 80 | 5 | 15 |

Properties of Firefighting Foam Composition

| Recipe | Surf. Tens. Du Noüy Ring | Inter-facial Surf. Tens. | Conduc-tivity (μMHO's/CM) | RI | Viscos-ity (cS) |
|---|---|---|---|---|---|
| 1 | 58.62 | 19.96 | 0.338 | 1.3348 | 9 |
| 2 | 45.75 | 12.38 | 0.377 | 1.3400 | 10 |
| 3 | 37.4 | 5.17 | 0.356 | 1.3368 | 10 |
| 4 | 28.71 | 1.79 | 0.468 | 1.3473 | 15 |
| 5 | 30.74 | 3.02 | 0.528 | 1.3544 | 21 |
| 6 | 29.16 | 1.65 | 0.589 | 1.3570 | 22 |
| 7 | 27.84 | | 0.609 | 1.3618 | 29 |
| 8 | 27.82 | 1.42 | 0.798 | 1.3808 | 154 |

TABLE 10

NRL Nozzle Testing of Surrogate Firefighting Foam Recipe 9

| 3% Expansion | 3% Drain Time (sec) |
|---|---|
| 5.78 | 143 |
| 6.1 | 138 |
| 5.78 | 147 |
| 5.21 | 152 |

Example 7

Uses of Exemplary Fire Foam Compositions Containing Deep Eutectic Solvents and Natural Deep Eutectic Solvents Any and all of the combinations listed herein are intended for the purpose of producing a firefighting foam. The deep eutectic solvents and NADES described herein are used to improve performance of the firefighting foams. In addition, any combination of these materials are also useful in the art of preparing surrogate fluids to be used in place of traditional firefighting foams for field testing, R&D testing, 3$^{rd}$ party approval testing and any other application where in the surrogate foams can be used as a replacement for calibration, testing equipment, annual field testing, etc. and conducting preliminary screening of foams in hardware. The deep eutectic solvents may be used in training foams or fire training test facilities to reduce their fluorine/fluorochemical footprint. Alternatively, these solvents may be used as an additive or solvent for fluoro containing foams to bolster the performance of "fluorine" containing foams. The solvents may be used as an additive to decrease fluorochemicals and produce ultra-low fluorine containing firefighting foam products. As well as in standard AFFF or AR-AFFF products to bolster performance.

What is claimed is:

1. An aqueous firefighting foam concentrate composition comprising:

greater than 20 wt. % of a deep eutectic solvent;

about 5 to 40 wt. % of at least one nonionic surfactant; and one or more additional firefighting foam components dissolved or dispersed in the deep eutectic solvent;

wherein:

the deep eutectic solvent comprises:

a first compound selected from a sugar and a sugar alcohol, wherein the sugar or sugar alcohol comprises sucrose, fructose, glucose, lactose, maltose, cellobiose, arabinose, ribose, ribulose, galactose, rhamnose, raffinose, xylose, mannose, trehalose, mannitol, sorbitol, inositol, xylitol, ribitol, galactitol, erythritol, or adonitol, or a combination thereof; and a second compound selected from a different sugar and a different sugar alcohol;

the one or more additional firefighting foam components comprises at least one biopolymer polysaccharide.

2. The composition of claim 1, wherein the one or more additional firefighting foam components comprises one or more additional surfactants, one or more additional solvents, one or more electrolytes, one or more foam stabilizers, one or more film formers, one or more corrosion inhibitors, or one or more antimicrobials, or a combination of two or more thereof.

3. The composition of claim 1, wherein the deep eutectic solvent further comprises an organic acid, an amide, a carbamide, an azole, an aromatic acid, an aliphatic acid, an alcohol, a diol, a triol, a sugar, a sugar alcohol, an amino acid, a betaine, an alkyl betaine, a quaternary ammonium salt, or a phosphonium salt, or a combination of two or more thereof.

4. The composition of claim 1, wherein the deep eutectic solvent further comprises a third compound selected from an organic acid and an amino acid.

5. The composition of claim 1, wherein the deep eutectic solvent further comprises a third compound selected from a sugar and a sugar alcohol; wherein the first, second and third compounds are not the same.

6. The composition of claim 1, wherein the deep eutectic solvent comprises at least two compounds selected from the group consisting of sucrose, glucose, and fructose.

7. The composition of claim 1, wherein the at least one biopolymer saccharide is selected from chitin, chitosan, dextran, maltodextrin, diutan gum, xanthan gum, rhamsan gum, agar, an alginate or a combination of two or more thereof.

8. The composition of claim 2, wherein the one or more additional solvents is selected from hexylene glycol, butyl cellulose, polyethylene glycol, methyl diproxitol, propylene glycol, propylene glycol, n-propyl ether, and tripropylene glycol methyl ether.

9. The composition of claim 2, wherein the one or more stabilizers is selected from ethylene glycol monoalkyl ethers, polyethylene glycol, diethylene glycol monoalkyl ethers, propylene glycol, dipropylene glycol monoalkyl ethers, triethylene glycol monoalkyl ethers, 1-butoxyethoxy-2-propanol, glycerine, hexylene glycol, and trimethylglycine.

10. The composition of claim 1, wherein the composition is free of fluorine containing compounds.

11. The firefighting foam concentrate of claim 1, wherein the nonionic surfactant comprises saponin and alkyl polyglycoside.

12. The composition of claim 1, wherein the composition comprises at least 25 wt. % of the deep eutectic solvent.

13. The firefighting foam concentrate composition of claim 1, wherein the composition has less than 0.5 wt. % fluorinated surfactants.

14. The firefighting foam concentrate composition of claim 1, wherein the composition is formed by a method comprising the steps of:

a) adding the at least one biopolymer polysaccharide to the deep eutectic solvent to provide a first mixture;

b) agitating the first mixture to form a first agitated mixture;

c) adding at least one nonionic surfactant to the agitated first mixture to provide a second mixture;

d) agitating the second mixture to form a second agitated mixture;

e) optionally, adding one or more additional components to the agitated second mixture prior to step f); and f) diluting the agitated second mixture with water.

15. The firefighting foam concentrate composition of claim 14, wherein the composition comprises:

greater than 20 to less than about 60 wt. % of the deep eutectic solvent, which comprises two or more sugars;

about 5 to 40 wt. % of the at least one nonionic surfactant; and about 0.43 to 10 wt. % of the at least one biopolymer polysaccharide; and water;

wherein the composition is free of fluorine containing compounds.

16. The firefighting foam concentrate composition of claim 14, wherein the composition comprises:

greater than 20 to less than about 60 wt. % of the deep eutectic solvent, which comprises sucrose and fructose;

about 5 to 40 wt. % of a combination of saponin and alkyl polyglycoside nonionic surfactants; and about 0.43 to 2.4 wt. % of a polysaccharide gum selected from xanthan gum, rhamsan gum, or a mixture thereof; and water;

wherein the composition is free of fluorine containing compounds.

17. An aqueous firefighting foam concentrate comprising:

greater than 20 wt. % of a deep eutectic solvent comprising two or more sugars or sugar alcohols, wherein the two or more sugars or sugar alcohols comprise sucrose, fructose, glucose, lactose, maltose, cellobiose, arabinose, ribose, ribulose, galactose, rhamnose, raffinose, xylose, mannose, trehalose, mannitol, sorbitol, inositol, xylitol, ribitol, galactitol, erythritol, or adonitol, or a combination thereof;

at least one biopolymer polysaccharide, which includes polysaccharide gum; and about 5 to 40 wt. % nonionic surfactant, which includes saponin and alkyl polyglycoside.

18. The firefighting foam concentrate of claim 17, wherein the polysaccharide gum includes one or more of xanthan gum, rhamsan gum, and diutan gum;

the two or more sugars or sugar alcohols include two or more of glucose, fructose, and sucrose; and the composition is free of fluorine-containing compounds.

19. The firefighting foam concentrate of claim 17, wherein the two or more sugars or sugar alcohols comprise fructose and sucrose.

20. The firefighting foam concentrate of claim 17, wherein the composition is free of fluorine containing compounds.

21. The firefighting foam concentrate of claim 17, wherein the composition has less than 0.5 wt. % fluorinated surfactants.

22. The firefighting foam concentrate of claim 17, wherein the concentrate is formed by a method comprising the steps of:

a) adding the at least one biopolymer polysaccharide to the deep eutectic solvent to provide a first mixture;

b) agitating the first mixture to form a first agitated mixture;

c) adding the nonionic surfactant to the agitated first mixture to provide a second mixture;

d) agitating the second mixture to form a second agitated mixture;

e) optionally, adding one or more additional components to the agitated second mixture prior to step f); and f) diluting the agitated second mixture with water.

23. The firefighting foam concentrate of claim 22, wherein the concentrate comprises:

greater than 20 to less than about 60 wt. % of the deep eutectic solvent, which comprises sucrose and fructose; and about 0.43 to 10 wt. % of the biopolymer polysaccharide, which comprises xanthan gum and/or rhamsan gum; and wherein the concentrate is free of fluorine containing compounds.

24. The concentrate of claim 17, wherein water constitutes about 50 to 75 wt. % of the deep eutectic solvent.

25. An aqueous firefighting foam concentrate comprising:

greater than 20 wt. % of a deep eutectic solvent comprising two or more sugars and/or sugar alcohols, wherein the two or more sugars or sugar alcohols comprise sucrose, fructose, glucose, lactose, maltose, cellobiose, arabinose, ribose, ribulose, galactose, rhamnose, raffinose, xylose, mannose, trehalose, mannitol, sorbitol, inositol, xylitol, ribitol, galactitol, erythritol, or adonitol, or a combination thereof;

at least one biopolymer polysaccharide, which includes polysaccharide gum; and about 5 to 40 wt. % nonionic surfactant, which includes saponin and alkyl polyglycoside;

wherein water constitutes about 25 to 75 wt. % of the deep eutectic solvent.

26. The concentrate of claim 25, wherein the composition is free of fluorine containing compounds.

27. A method of fighting a fire comprising administering the composition according to claim 1 to a fire.

28. A method of forming a firefighting foam comprising mixing water with the firefighting foam concentrate of claim 17; and aerating the resulting mixture.

29. A method of fighting a fire comprising administering the firefighting foam of claim 28 to a fire.

30. A method of making the firefighting foam concentrate composition of claim 1 comprising:

a) adding the at least one biopolymer polysaccharide to the deep eutectic solvent to form a mixture;

b) agitating the mixture to form an agitated mixture;

c) adding a first surfactant to the agitated mixture prior to step f);

d) adding a second surfactant to the agitated mixture prior to step f);

e) optionally, adding one or more additional components comprising one or more surfactants, one or more additional solvents, one or more electrolytes, one or more foam stabilizers, one or more additional film formers, one or more corrosion inhibitors, or one or more antimicrobials to the agitated mixture prior to step f); and f) adding water to the agitated mixture.

* * * * *